US011804168B2

(12) United States Patent
Ock et al.

(10) Patent No.: US 11,804,168 B2
(45) Date of Patent: Oct. 31, 2023

(54) DISPLAY DEVICE INCLUDING AN OPTICAL MODULE SUPERPOSED ON A DISPLAY AREA

(71) Applicant: LG Display Co., Ltd., Seoul (KR)

(72) Inventors: Jong-Hwan Ock, Busan (KR); Yu-Hoon Kim, Seoul (KR); Jung-Geun Jo, Gimpo-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/142,054

(22) Filed: Jan. 5, 2021

(65) Prior Publication Data

US 2021/0241680 A1 Aug. 5, 2021

(30) Foreign Application Priority Data

Jan. 31, 2020 (KR) ..... 10-2020-0011855

(51) Int. Cl.
*G09G 3/32* (2016.01)
*G09G 3/20* (2006.01)

(52) U.S. Cl.
CPC ..... *G09G 3/32* (2013.01); *G09G 3/2003* (2013.01); *G09G 2310/08* (2013.01); *G09G 2320/02* (2013.01); *G09G 2320/0626* (2013.01); *G09G 2320/0673* (2013.01); *G09G 2320/0686* (2013.01)

(58) Field of Classification Search
None
See application file for complete search history.

(56) References Cited

U.S. PATENT DOCUMENTS

2003/0095135 A1* 5/2003 Kaasila ..... G06F 3/0481 345/613
2008/0297448 A1 12/2008 Mizukoshi et al.
2016/0307487 A1 10/2016 Ikeda et al.
2018/0165533 A1* 6/2018 Cho ..... G06V 40/10
2019/0164489 A1 5/2019 Zhang et al.
2019/0310724 A1* 10/2019 Yeke Yazdandoost ..... G06V 40/1318
2019/0373166 A1* 12/2019 Jia ..... G09G 3/2003
2020/0066809 A1* 2/2020 Liu ..... H01L 27/3234
(Continued)

FOREIGN PATENT DOCUMENTS

CN 109559650 A 4/2019
CN 209766422 U 12/2019
(Continued)

*Primary Examiner* — Benjamin C Lee
*Assistant Examiner* — Emily J Frank
(74) *Attorney, Agent, or Firm* — Seed IP Law Group LLP

(57) ABSTRACT

In at least one embodiment, a display device includes a panel including a display area in which a plurality of pixels is arranged. An optical module is superposed on the display area. The display area has a low-resolution area having a polygonal shape and superposed on the optical module and a high-resolution area neighboring the low-resolution area, unit pixels having the same size as those of the high-resolution area are arranged in a lower pixel density than that of the high-resolution area and transmission areas are disposed adjacent to the unit pixels in the low-resolution area, and unit pixels and transmission areas are arranged in different forms in a boundary area of the high-resolution area neighboring the low-resolution area according to slopes of the boundary area.

20 Claims, 17 Drawing Sheets

(56) References Cited

U.S. PATENT DOCUMENTS

| | | | | |
|---|---|---|---|---|
| 2020/0211507 | A1* | 7/2020 | Clarke | H04N 13/305 |
| 2021/0049955 | A1* | 2/2021 | Bae | G09G 3/2074 |
| 2021/0049977 | A1 | 2/2021 | Li | |
| 2021/0065606 | A1* | 3/2021 | Park | G09G 3/20 |
| 2021/0065625 | A1* | 3/2021 | Wang | H01L 27/3234 |
| 2021/0358379 | A1* | 11/2021 | Li | G09G 3/2074 |

FOREIGN PATENT DOCUMENTS

| | | | |
|---|---|---|---|
| EP | 3 346 363 | A2 | 7/2018 |
| EP | 3 428 967 | A1 | 1/2019 |
| JP | 2016-206243 | A | 12/2016 |
| WO | 2019/242510 | A1 | 12/2019 |

* cited by examiner

Before luminance compensation

After application of luminance compensation

FIG. 10A
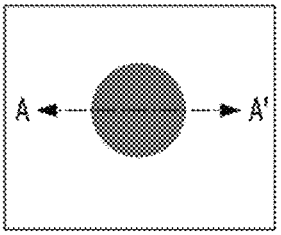
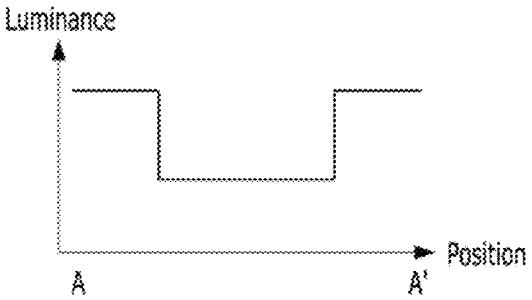
FIG. 10B
FIG. 10C
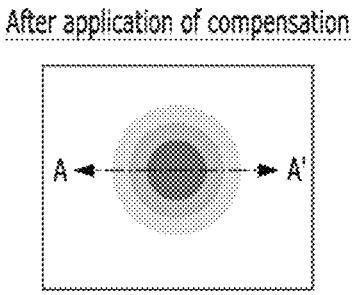
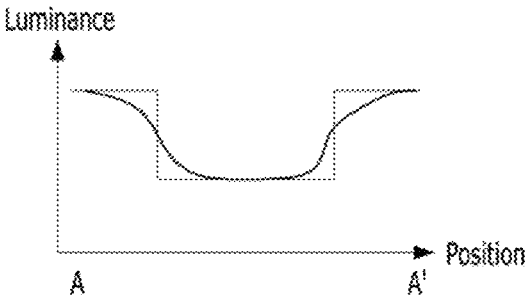
FIG. 10D

FIG. 11A
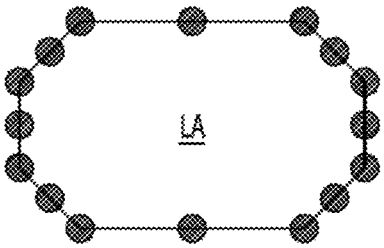
FIG. 11B
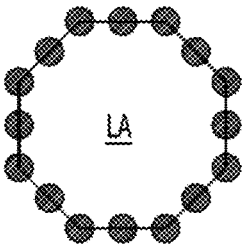
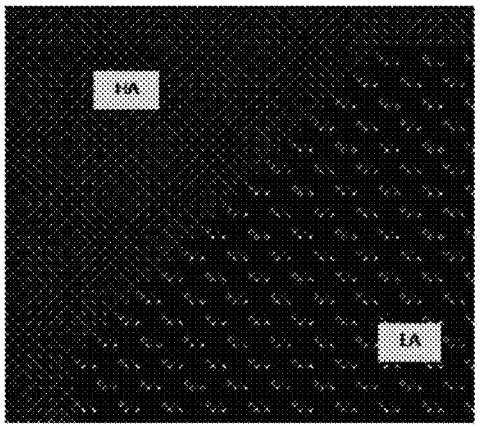
FIG. 11C
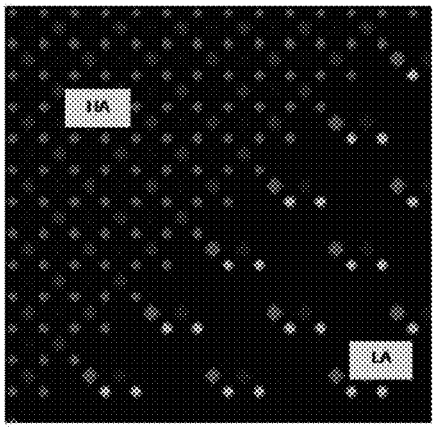
FIG. 11D

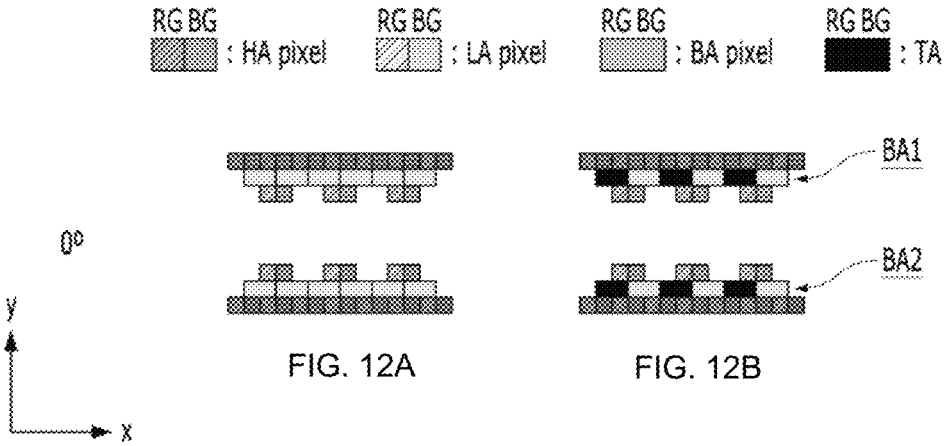
FIG. 12A
FIG. 12B
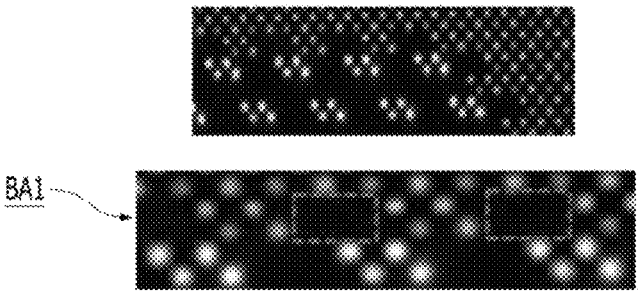
FIG. 12C

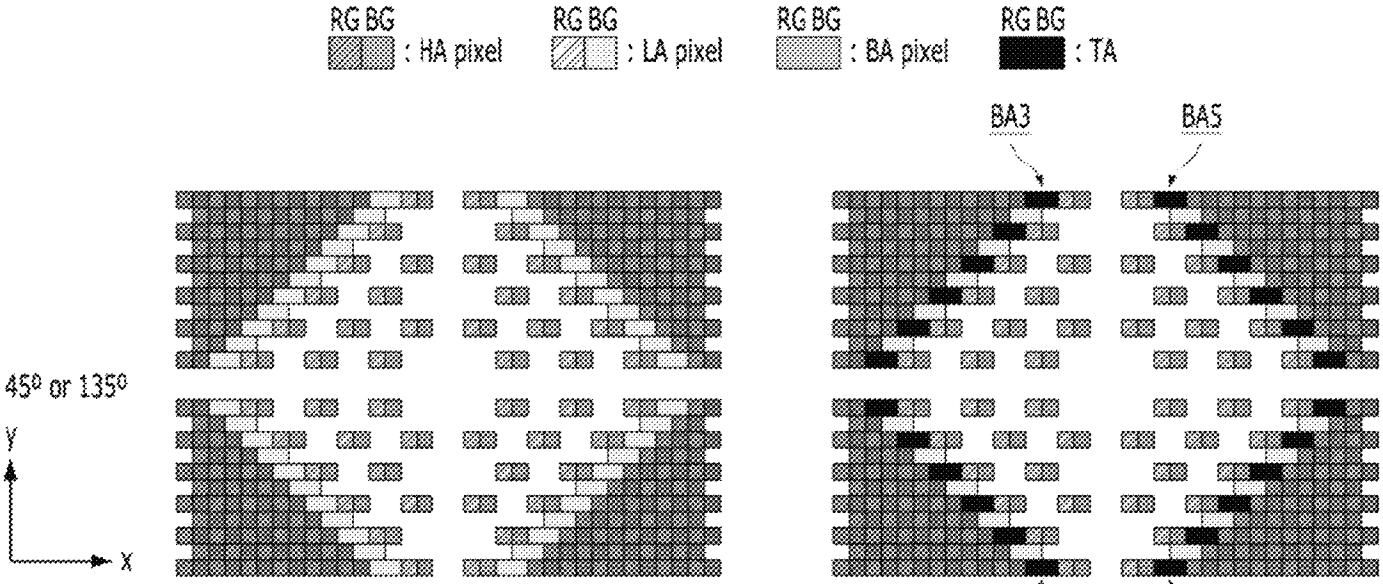
FIG. 13A
FIG. 13B
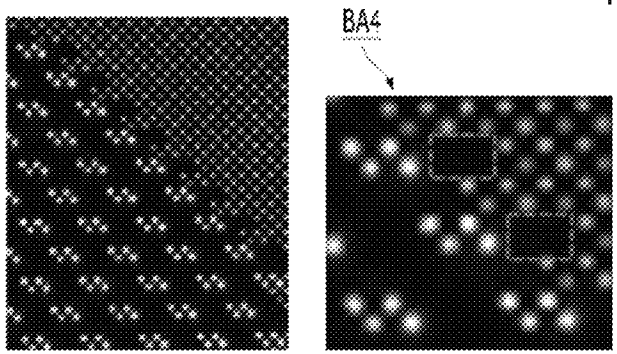
FIG. 13C

<Pixel arrangement structure in boundary area>
<Extended boundary area>
<General Image>
<128-gray image>
Bright line
Dark line

DISPLAY DEVICE INCLUDING AN OPTICAL MODULE SUPERPOSED ON A DISPLAY AREA

CROSS-REFERENCE TO RELATED APPLICATION(S)

This application claims the benefit of Korean Patent Application No. 10-2020-0011855, filed on Jan. 31, 2020, which is hereby incorporated by reference as if fully set forth herein.

BACKGROUND

Technical Field

The present disclosure relates to a display device capable of improving definition of a low-resolution area in a display area having a high-resolution area and the low-resolution area.

Description of the Related Art

Electronic devices such as smartphones and tablets are equipped with an optical module, for example, a camera module, along with a display device.

Although a camera module is generally disposed under a through-hole penetrating a bezel of an electronic device, there is demand for a structure in which a camera module is disposed on the backside of a display area of a display device and light transmission in the display area is used since a bezel size has recently decreased in order to extend the display area.

A region superposed on the camera module in the display area needs to have low resolution such that sufficient light transmissivity can be secured.

When the display area has a high-resolution area and a low-resolution area, there are problems that a boundary area between the high-resolution area and the low-resolution area is visually recognizable and definition deterioration of visual recognition of the low-resolution area due to luminance deterioration in the low-resolution area.

BRIEF SUMMARY

The present disclosure provides a display device capable of improving definition deterioration due to recognition of a boundary area of a low-resolution area superposed on an optical module in a display area and enhancing the definition of the low-resolution area to a recognition level equivalent to that of a high-resolution area.

A display device according to an embodiment includes: a panel including a display area in which a plurality of pixels is arranged; and an optical module superposed on the display area, wherein the display area has a low-resolution area having a polygonal shape and superposed on the optical module and a high-resolution area neighboring the low-resolution area, in the low-resolution area, unit pixels having the same size as those of the high-resolution area are arranged in a lower pixel density than that of the high-resolution area and transmission areas are disposed adjacent to the unit pixels, and unit pixels and transmission areas are arranged in different forms in a boundary area of the high-resolution area neighboring the low-resolution area according to slopes of the boundary area.

The low-resolution area may have an octagonal shape, and the boundary area of the high-resolution area may have a plurality of boundary areas having different slopes.

The plurality of boundary areas of the high-resolution area may include first and second boundary areas disposed in an x-axis direction and facing each other in a y-axis direction, the first and second boundary areas may include one unit pixel per area of two unit pixels and a transmission area corresponding to each unit pixel area positioned in the x-axis direction, and a position of a transmission area per area of two unit pixels in the first boundary area may be opposite to a position of a transmission area per area of two unit pixels in the second boundary area.

The plurality of boundary areas of the high-resolution area may include third and fourth boundary areas disposed in a first diagonal direction at a slope of 45° to the x-axis direction and fifth and sixth boundary areas disposed in a second diagonal direction at a slope of 135° to the x-axis direction, the third and fourth boundary areas may include one unit pixel per area of two unit pixels and a transmission area corresponding to each unit pixel area positioned in the first diagonal direction, the fifth and sixth boundary areas may include one unit pixel per area of two unit pixels and a transmission area corresponding to each unit pixel area positioned in the second diagonal direction, and the transmission area per area of two unit pixels may be disposed at the same position in the third to sixth boundary areas.

The plurality of boundary areas of the high-resolution area may include seventh and eighth boundary areas disposed in the y-axis direction and facing each other in the x-axis direction, the seventh and eighth boundary areas may include one unit pixel per area of four unit pixels and a transmission area corresponding to each unit pixel area positioned in the y-axis direction, and a position of a transmission area per area of four unit pixels in the seventh boundary area may be different from a position of a transmission area per area of four unit pixels in the eighth boundary area.

A transmission area of the seventh boundary area may be positioned in the area of the first unit pixel per area of four unit pixels in the seventh boundary area, and a transmission area of the eighth boundary area may be positioned in the area of the fourth unit pixel per area of four unit pixels in the eighth boundary area.

The low-resolution area may include one unit pixel per area of four unit pixels and a transmission area corresponding to three unit pixel areas.

The area of the low-resolution area may be larger than the area of a region where the low-resolution area is superposed on the optical module.

The display area according to an embodiment may include a plurality of low-resolution areas superposed on a plurality of optical modules.

A timing controller according to an embodiment may compensate for luminance by applying different weights for colors to image data of the low-resolution area. The different color weights may be derived using proportions of luminances for colors of the low-resolution area to those of the high-resolution area using results of measurement of luminance differences for colors in the low-resolution area in contrast to the high-resolution area.

The timing controller may convert input 3-color (RGB) data for the low-resolution area into 4-color (WRGB) data, apply the color weights to the converted 4-color data to generate corrected 4-color data, convert the corrected 4-color data into corrected 3-color data, and output the corrected 3-color data.

The color weights may be less than a maximum weight using a ratio of the number of unit pixels per mask area of the high-resolution area to the number of unit pixels per mask area of the low-resolution area.

The timing controller may perform de-gamma processing on the color weights and apply the de-gamma processed color weights to the converted 4-color data.

A red weight and a blue weight among the color weights may be greater than a green weight, and a white weight may be greater than the green weight and less than the blue weight.

The timing controller may derive a maximum gray range that is able to be compensated using the color weights using a ratio of the number of unit pixels per mask area of the low-resolution area to the number of unit pixels per mask area of the high-resolution area in image data of the low-resolution area, and perform luminance compensation on grays equal to or greater than 0 gray and equal to or less than the maximum gray range that is able to be compensated using the color weights.

The timing controller may perform luminance compensation on high-gray data exceeding the maximum gray range that is able to be compensated by applying smoothing processing of gradually reducing luminance from the high-resolution area to the low-resolution area to the high-gray data.

The display device according to an embodiment can prevent visual recognition of a boundary area of a low-resolution area and improve definition deterioration in the low-resolution area by compensating for the luminance of the low-resolution area and differently arranging unit pixels and transmission areas in a boundary area of a high-resolution area neighboring the low-resolution area having an octagonal shape according to slopes of the boundary area, thereby improving the entire definition.

BRIEF DESCRIPTION OF THE SEVERAL VIEWS OF THE DRAWINGS

FIGS. 10A, 10B, 10C, and 10D are diagrams showing smoothing processing performed on a boundary area of a low-resolution area having a high grayscale according to an embodiment.

FIGS. 11A, 11B, 11C, and 11D are diagrams showing an octagonal low-resolution area according to an embodiment.

FIGS. 12A, 12B, and 12C are diagrams showing a pixel arrangement structure at a boundary area between a high-resolution area and a low-resolution area in an x direction according to an embodiment.

FIGS. 13A, 13B, and 13C are diagrams showing a pixel arrangement structure at a boundary area between a high-resolution area and a low-resolution area in diagonal directions according to an embodiment.

DETAILED DESCRIPTION

Hereinafter, preferred embodiments of the present disclosure will be described with reference to the drawings.

Figures 1A, 1B:
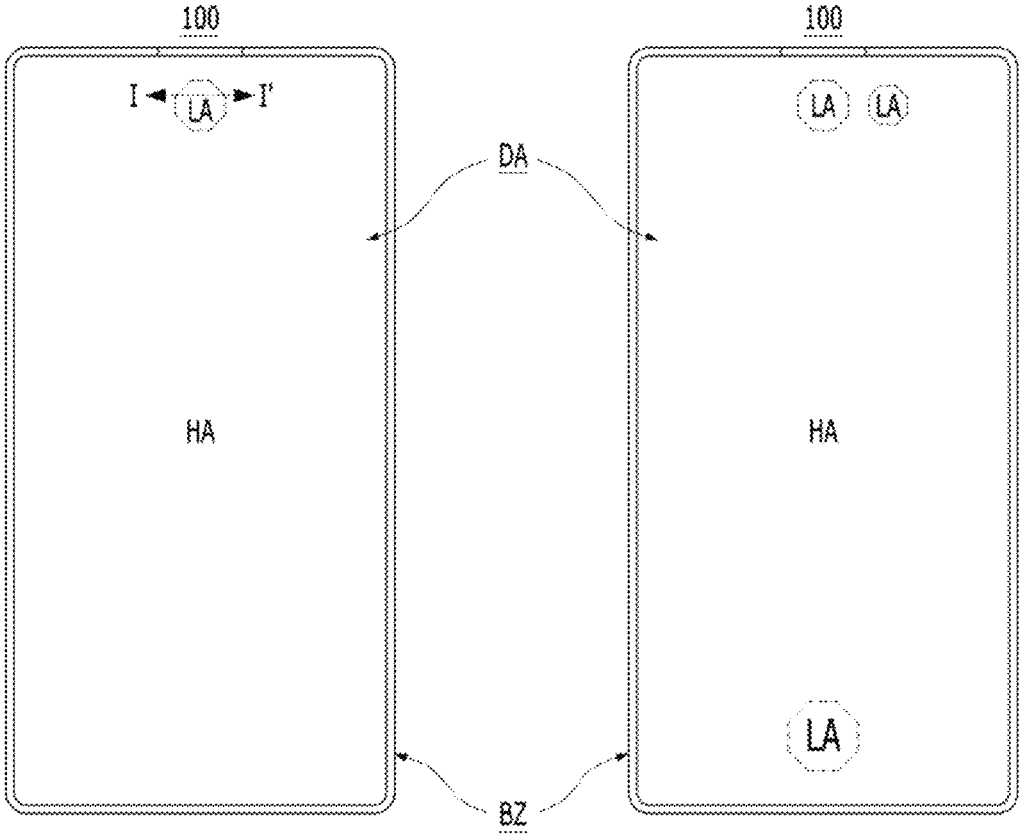
FIGS. 1A and 1B are diagrams showing a display area of a display device according to an embodiment.
Figure 2:
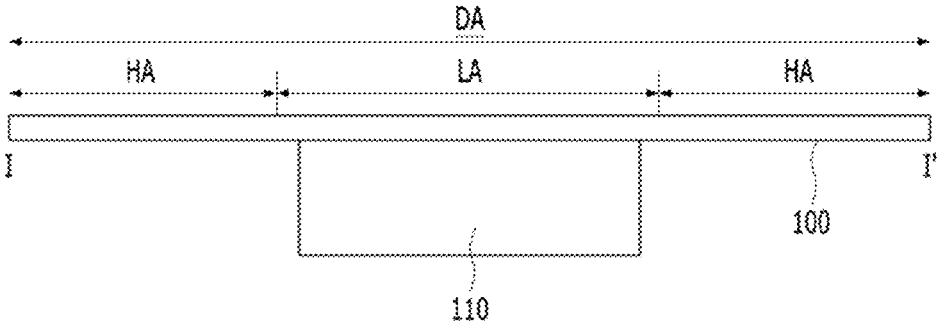
FIG. 2 is a cross-sectional view showing a superposition structure of the display area and an optical module, taken along line I-I' in the display area shown in FIG. 1A.

FIGS. 1A and 1B are diagrams showing a display area of a display device according to an embodiment and FIG. 2 is a cross-sectional view showing a superposition structure of the display area of a panel and an optical module, taken along line I-I' in the display area shown in FIG. 1A.

An electroluminescent display may be applied as the display device according to an embodiment. As an electroluminescent display, an organic light emitting diode (OLED) display device, a quantum-dot light emitting diode display device, or an inorganic light emitting diode display device may be used.

Referring to FIGS. 1 and 2, the display device according to an embodiment includes a panel 100 having a display area DA in which a plurality of pixels is arranged to display an image and a bezel area BZ surrounding the display area DA. The display area DA may be represented as a pixel array area or an active area. The bezel area BZ may be small or may be omitted. The panel 100 may further include a touch sensor screen superposed on the display area A to sense user touch, and the touch sensor screen may be embedded in the panel 100 or disposed on the display area DA of the panel 100.

The display area DA of the panel 100 has a high-resolution area HA corresponding to a large part of the display area DA and a low-resolution area LA superposed on an optical module 110 disposed on the backside of the panel 100. The high-resolution area HA includes unit pixels and has high PPI (pixels per inch) and thus has a pixel arrangement structure with a high pixel density. The low-resolution area LA includes a pixel region (light emission region) corresponding to unit pixels and a transmission area for light transmission and has low PPI and thus has a pixel arrangement structure with a low pixel density.

The optical module 110 superposed on the low-resolution area LA can secure sufficient transmissivity for incident light or projected light thereof, which penetrates the low-resolution area LA, according to the transmission area of the low-resolution area LA. To secure the light transmissivity of the optical module 110, it is desirable that the area occupied by the transmission area be larger than the area occupied by the pixel region in the low-resolution area and it is desirable that the size of the low-resolution area LA be larger than the size of a region where the low-resolution area LA is superposed on the optical module 110, as shown in FIG. 2.

The optical module 110 using light penetrating the low-resolution area LA of the display area DA may be a camera module and may further include at least one of various optical sensors such as an infrared sensor, an illumination sensor, an RGB sensor and a fingerprint sensor.

For example, the display area DA of the panel 100 may include a single low-resolution area LA surrounded by the high-resolution area HA, as shown in FIG. 1A, and the optical module 110 using light penetrating the low-resolution area LA may be a camera module. The display area DA of the panel 100 may include a plurality of low-resolution areas LA surrounded by the high-resolution area HA, and a plurality of optical modules individually superposed on the plurality of low-resolution areas LA may include camera modules, illumination sensors, fingerprint sensors, and the like, as shown in FIG. 1B. The number of low-resolution areas LA disposed in the display area DA may be changed as necessary. In addition, the low-resolution area LA in the display area DA of the panel 100 may be used for various purposes as necessary.

In the display device according to an embodiment which includes the low-resolution area LA having an octagonal shape, it is possible to improve definition deterioration due to visual recognition of a boundary area between the low-resolution area LA and the high-resolution area HA by arranging a transmission area in the boundary area in which outermost unit pixels of the high-resolution area HA neighboring the octagonal low-resolution area LA are positioned in different forms according to slopes of the boundary area instead of removing unit pixels. This will be described in detail later.

Furthermore, the display device according to an embodiment can improve definition deterioration due to visual recognition of the low-resolution area LA by compensating for the luminance of the low-resolution area LA having a lower pixel density, that is, a smaller number of unit pixels emitting light, than that of the high-resolution area HA to a level equivalent to that of the high-resolution area HA. This will be described in detail later.

Figure 3:
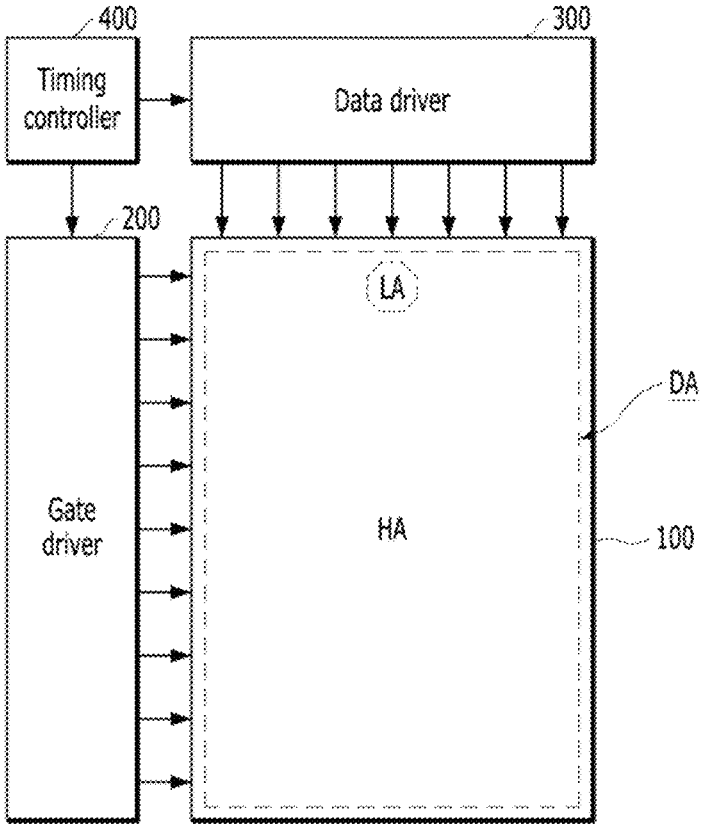
FIG. 3 is a block diagram showing a circuit configuration of the display device according to an embodiment.
Figure 4A:
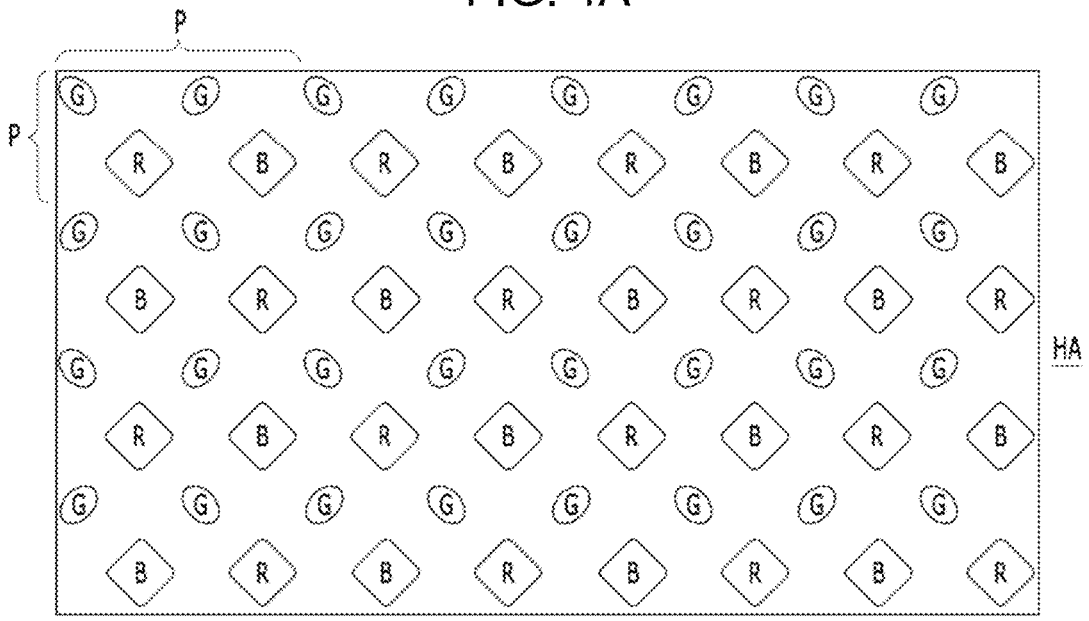
FIGS. 4A and 4B are diagrams showing pixel arrangement structures of a high-resolution area and a low-resolution area according to an embodiment.
Figure 4B:
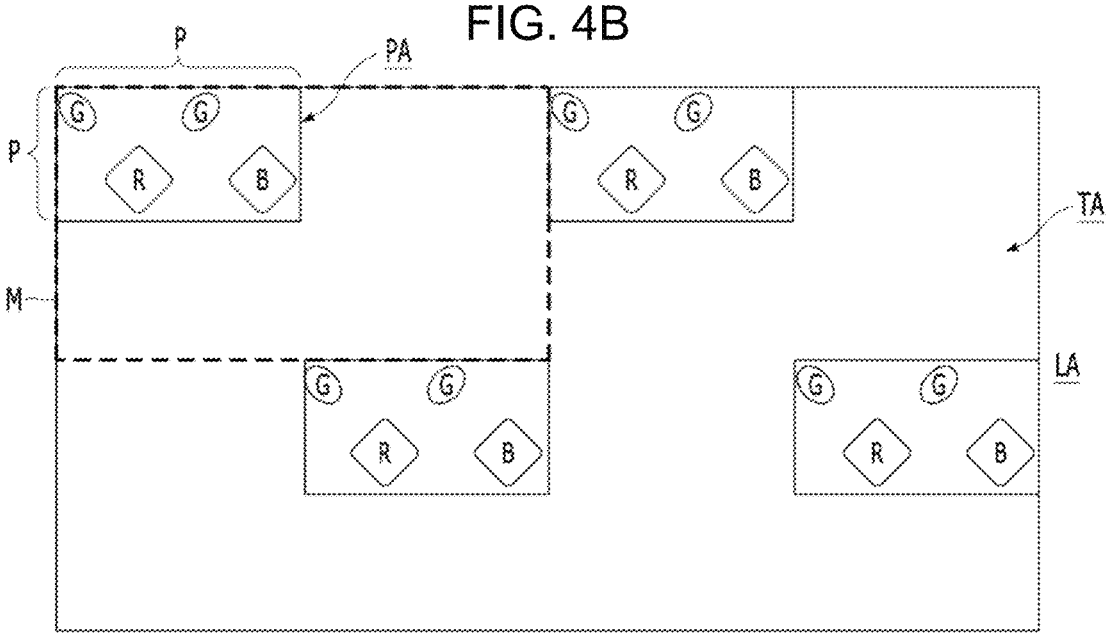
Figure 5:
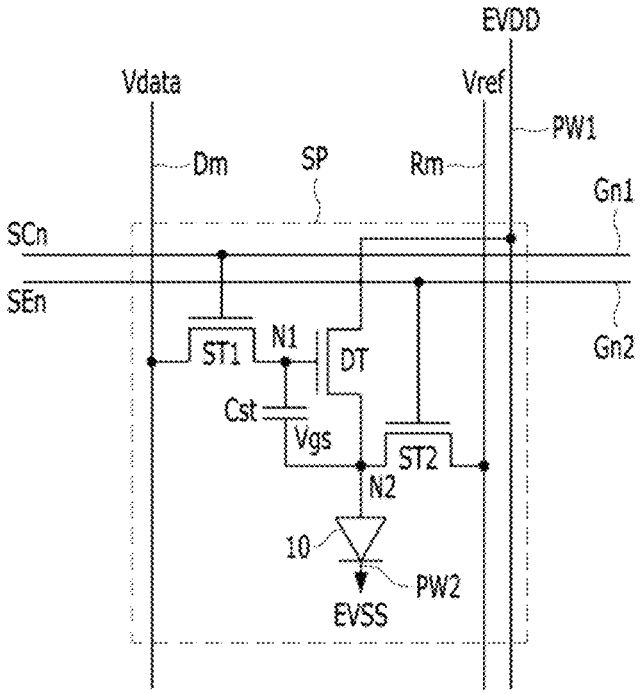
FIG. 5 is an equivalent circuit diagram of a subpixel according to an embodiment.

FIG. 3 is a block diagram showing a circuit configuration of the display device according to an embodiment, FIGS. 4A and 4B are diagrams showing pixel arrangement structures of a high-resolution area and a low-resolution area according to an embodiment, and FIG. 5 is an equivalent circuit diagram of a subpixel according to an embodiment.

Referring to FIG. 3, the display device includes the panel 100, a gate driver 200, a data driver 300, a timing controller 400, and the like. The gate driver 200 and the data driver 300 may be defined as a panel driver for driving the panel 100. The gate driver 200, the data driver 300 and the timing controller 400 may be defined as a driver.

The display area DA of the panel 100 includes a plurality of unit pixels, and each unit pixel displays an image using red (R), green (G) and blue (B) subpixels. As shown in FIGS. 4A and 4B, each unit pixel P may be composed of four subpixels RGBG. In an RGBG pixel arrangement structure shown in FIGS. 4A and 4B, red (R) subpixels and blue (B) subpixels other than green (G) subpixels may be alternately arranged in the horizontal direction and the vertical direction.

The display area DA of the panel 100 has a high-resolution area HA and a low-resolution area LA superposed on the optical module 110 disposed on the backside of the panel 100.

Referring to FIGS. 4A and 4B, the high-resolution area HA having high PPI has a pixel arrangement structure composed of unit pixels P. The low-resolution area LA having low PPI has a pixel arrangement structure including pixel areas PA each corresponding to a unit pixel P and a transmission area TA disposed adjacent to the pixel area PA and having a low pixel density. The PPI of the low-resolution area LA may be a quarter that of the high-resolution area HA. The unit pixel P may have the same size in the high-resolution area HA and the low-resolution area LA.

When a mask area M having a size of 2*2 unit pixels is defined in the low-resolution area LA, each mask area M has a pixel area PA corresponding to a single unit pixel P and a transmission area corresponding to an area in which three unit pixels are removed, and thus the transmission area TA may have an area larger than the pixel area PA. In other words, the low-resolution area LA may have one unit pixel P per area of four unit pixels and a transmission area TA corresponding to the area of three unit pixels.

For example, in the low-resolution area LA, each pixel area PA may be disposed in a (4k−3)-th row (k being a positive integer) in any one of odd-numbered columns and even-numbered columns and disposed in a (4k−1)-th row in other columns, and the transmission area TA may be disposed in the remaining area. Accordingly, the optical module on which the low-resolution area LA is superposed can secure sufficient light transmissivity through the transmission area TA larger than the pixel area PA to provide high performance of a camera or an optical sensor.

Each subpixel SP includes an emission element and a pixel circuit for independently driving the emission element. An organic light emitting diode, a quantum-dot light emitting diode, or an inorganic light emitting diode may be applied as the emission element. The pixel circuit includes a plurality of TFTs including at least a driving TFT for driving the emission element and a switching TFT for supplying a data signal to the driving TFT, and a storage capacitor which stores a driving voltage Vgs corresponding to the data signal supplied through the switching TFT and provides the driving voltage Vgs to the driving TFT. In addition, the pixel circuit may further include a plurality of TFTs which initializes three electrodes (a gate, a source and a drain) of the driving TFT, connects the driving TFT in a diode structure for threshold voltage compensation, or controls an emission time of the emission element. Various configurations such as 3T1C (3 TFTs and 1 capacitor) and 7T1C (7 TFTs and 1 capacitor) may be applied as a pixel circuit configuration.

For example, each pixel P has a pixel circuit including at least an emission element 10 connected between a power line through which a high driving voltage (first driving voltage; EVDD) is supplied and a common electrode through which a low driving voltage (second driving voltage; EVSS) is supplied, and first and second switching TFTs ST1 and ST2, a driving TFT DT and a storage capacitor Cst for independently driving the emission element 10, as shown in FIG. 5.

The emission element 10 includes an anode connected to a source node N2 of the driving TFT DT, a cathode connected to an EVSS line PW2, and an organic emission layer formed between the anode and the cathode. The anode is independently provided for each subpixel but the cathode may be a common electrode shared by all subpixels. The emission element 10 generates light with brightness proportional to a value of driving current in such a manner that electrons from the cathode are injected into the organic emission layer and holes from the anode are injected into the organic emission layer when the driving current is supplied from the driving TFT DT and fluorescent or phosphorescent materials are emitted according to recombination of the electrons and the holes in the organic emission layer.

The first switching TFT ST1 is driven by a scan pulse signal SCn supplied from the gate driver 200 to a gate line Gn1 and transmits a data voltage Vdata supplied from the data driver 300 to a data line Dm to a gate node N1 of the driving TFT DT.

The second switching TFT ST2 is driven by a sense pulse signal SEn supplied from the gate driver 200 to another gate line Gn2 and transmits a reference voltage Vref supplied from the data driver 300 to a reference line Rm to the source node N2 of the driving TFT DT. In a sensing mode, the second switching TFT ST2 can provide current in which characteristics of the driving TFT DT or characteristics of the emission element 10 are reflected to the reference line Rm.

The storage capacitor Cst connected between the gate node N1 and the source node N2 of the driving TFT DT charges a difference voltage between the data voltage Vdata and the reference voltage Vref respectively supplied to the gate node N1 and the source node N2 through the first and second switching TFTs ST1 and ST2 as the driving voltage Vgs of the driving TFT DT and holds the charged driving voltage Vgs for an emission period in which the first and second switching TFTs ST1 and ST2 are turned off.

The driving TFT DT causes the emission element 10 to emit light by controlling a current supplied through an EVDD line PW1 according to the driving voltage Vgs supplied from the storage capacitor Cst to provide a driving current determined by the driving voltage Vgs to the emission element 10.

The gate driver 200 is controlled by a plurality of gate control signals supplied from the timing controller 400 and individually drives gate lines of the panel 100. The gate driver 200 provides a scan signal of a gate on voltage to a corresponding gate line in a driving period of the gate line and provides a gate off voltage to the gate line in a non-driving period of the gate line.

The data driver 300 is controlled by data control signals supplied from the timing controller 400, converts digital data supplied from the timing controller 400 into analog data signal and provides a corresponding data signal to each data line of the panel 100. Here, the data driver 300 converts the digital data into the analog data signal using grayscale voltages obtained by subdividing a plurality of reference gamma voltages supplied from a gamma voltage generator. The data driver 300 can provide the reference voltage to the reference line.

Meanwhile, the data driver 300 can provide a data voltage for sensing to data lines to drive pixels according to control of the timing controller 400, sense a pixel current representing electrical characteristics of the driven pixels as a voltage through the reference line Rm, convert the voltage into digital sensing data and provide the digital sensing data to the timing controller 400 in the sensing mode.

The timing controller 400 controls the gate driver 200 and the data driver 300 using timing control signals supplied from an external system and timing setting information stored therein. The timing control signals may include a dot clock signal, a data enable signal, a vertical synchronization signal, a horizontal synchronization signal, and the like. The timing controller 400 generates a plurality of gate control signals for controlling driving timing of the gate driver 200 and provides the gate control signals to the gate driver 200. The timing controller 400 generates a plurality of data control signals for controlling driving timing of the data driver 300 and provides the data control signals to the data driver 300.

The timing controller 400 may perform various types of image processing on received input image data and output the processed data to the data driver 300.

Particularly, the timing controller 400 can improve recognized definition of the low-resolution area LA by applying different weights to colors to compensate for a luminance deviation of the low-resolution area LA having lower pixel density than that of the high-resolution area HA to a level equivalent to that of the high-resolution area HA. This will be described in detail later.

The timing controller 400 can analyze image data and control maximum luminance according to an average picture level (APL) to reduce power consumption.

The timing controller 400 may further perform definition enhancement processing such as compensation of initial characteristic deviation of each pixel and deterioration (image sticking) compensation on image data. The timing controller 400 can drive the panel 100 in the sensing mode by controlling the gate driver 200 and the data driver 300 and execute a function of sensing a threshold voltage of the driving TFT DT, mobility of the driving TFT DT and a threshold voltage of the emission element 10, in which characteristic deviation and deterioration of each pixel of the panel 100 have been reflected, through the data driver 300. The timing controller 400 can perform definition enhancement processing for compensating for characteristic deviation and deterioration of each pixel using a sensing result. The timing controller 400 may accumulate data used in each subpixel as stress data and further perform definition enhancement processing for compensating for deterioration of each subpixel according to the accumulated stress data.

Figure 6:
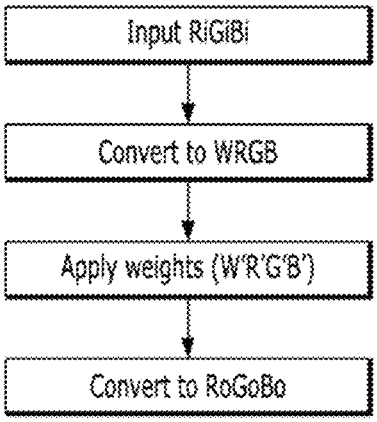
FIG. 6 is a flowchart showing a method of compensating for luminance of the display device according to an embodiment.

FIG. 6 is a flowchart showing a method of compensating for the luminance of a low-resolution area of the display device according to an embodiment, which is performed by the timing controller 400 shown in FIG. 3.

Referring to FIG. 6, the timing controller 400 receives source 3-color data RiGiBi with respect to the low-resolution area LA and converts the source 3-color data RiGiBi into 4-color data WRGB using an RGB-to-WRGB (3 colors-to-4 colors) conversion method. For example, the timing controller 400 converts the source 3-color data RiGiBi into the 4-color data WRGB by generating W data from a minimum value of the source 3-color data RiGiBi and subtracting the W data from RiGiBi data to generate RGB data as represented by Mathematical Expression 1.

$$W=\mathrm{Min}(Ri,Gi,Bi)$$

$$R=Ri-W$$

$$G=Gi-W$$

$$B=Bi-W$$

<Mathematical Expression 1>

The timing controller 400 derives compensated 4-color data W'R'G'B' by applying color weights Weight_W, Weight_R, Weight_G and Weight_B to the converted 4-color data WRGB, as represented by Mathematical Expression 2, converts the compensated 4-color data W'R'G'B' into compensated R'G'B' data and outputs the compensated R'G'B'.

(Mathematical Expression 2)

$$*WRGB\ \text{Max Gray Range} = 255 - \left(255 \times \left(\frac{\text{Low}_N}{\text{High}_N}\right)^{\frac{1}{2.2}}\right)$$

$$W' = \text{Weight_W}^{\frac{1}{2.2}} \times W$$

$$R' = \text{Weight_R}^{\frac{1}{2.2}} \times R$$

$$G' = \text{Weight_G}^{\frac{1}{2.2}} \times G$$

$$B' = \text{Weight_B}^{\frac{1}{2.2}} \times B$$

$$*WRGB\ \text{Weight Max} = \frac{\text{High_N}}{\text{Low_N}}$$

$$\text{Weight_R} \le R\ \text{Weight Max}$$

$$\text{Weight_G} \le G\ \text{Weight Max}$$

$$\text{Weight_B} \le B\ \text{Weight Max}$$

$$\text{Weight_W} \le W\ \text{Weight Max}$$

When gray values of WRGB data with respect to the low-resolution area LA exceed a maximum gray range (WRGB Max Gray Range) which can be compensated for, luminance compensation is impossible, and the maximum gray range (WRGB Max Gray Range) which can be compensated for can be determined using a ratio of the number of unit pixels, Low_N, in the mask area M in the low-resolution area LA to the number of unit pixels, High_N, in the mask area M in the high-resolution area HA, as represented by Mathematical Expression 2. For example, when the ratio of the number of unit pixels, Low_N, in the mask area M in the low-resolution area LA to the number of unit pixels, High_N, in the mask area M in the high-resolution area HA is ¼, as shown in FIGS. 4A and 4B, the maximum gray range (WRGB Max Gray Range) which can be compensated for according to Mathematical Expression 2 can be calculated as 135 gray. Accordingly, luminance compensation in which the color weights Weight_W, Weight_R, Weight_G and Weight_B are applied to WRGB data with respect to the low-resolution area LA can be performed only on WRGB data corresponding to 0 to 135 gray values and may not be performed on high gray values exceeding 135 gray.

In Mathematical Expression 2, the color weights Weight_W, Weight_R, Weight_G and Weight_B are luminance compensation values determined in order to compensate for luminance differences. Accordingly, when the weights Weight_W, Weight_R, Weight_G and Weight_B are applied to WRGB data that is gray values, de-gamma is applied and de-gamma color weights $\text{Weight_W}^{1/2.2}$, $\text{Weight_R}^{1/2.2}$ and $\text{Weight_G}^{1/2.2}$, $\text{Weight_B}^{1/2.2}$ are applied to the WRGB data for the colors.

In Mathematical Expression 2, the color weights Weight_W, Weight_R, Weight_G and Weight_B are determined to be equal to or less than a maximum weight of WRGB (WRGB Weight Max). The maximum weight of WRGB (WRGB Weight Max) may be determined as the ratio of the number of unit pixels, Low_N, in the mask area M in the low-resolution area LA to the number of unit pixels, High_N, in the mask area M in the high-resolution area HA, as represented by Mathematical Expression 2. For example, when the ratio of the number of unit pixels, Low_N, in the mask area M in the low-resolution area LA to the number of unit pixels, High_N, in the mask area M in the high-resolution area HA is ¼, as shown in FIGS. 4A and 4B, the maximum weight of WRGB (WRGB Weight Max) can be 4 and the color weights Weight_W, Weight_R, Weight_G and Weight_B can be determined to be equal to or less than 4.

Figure 7:
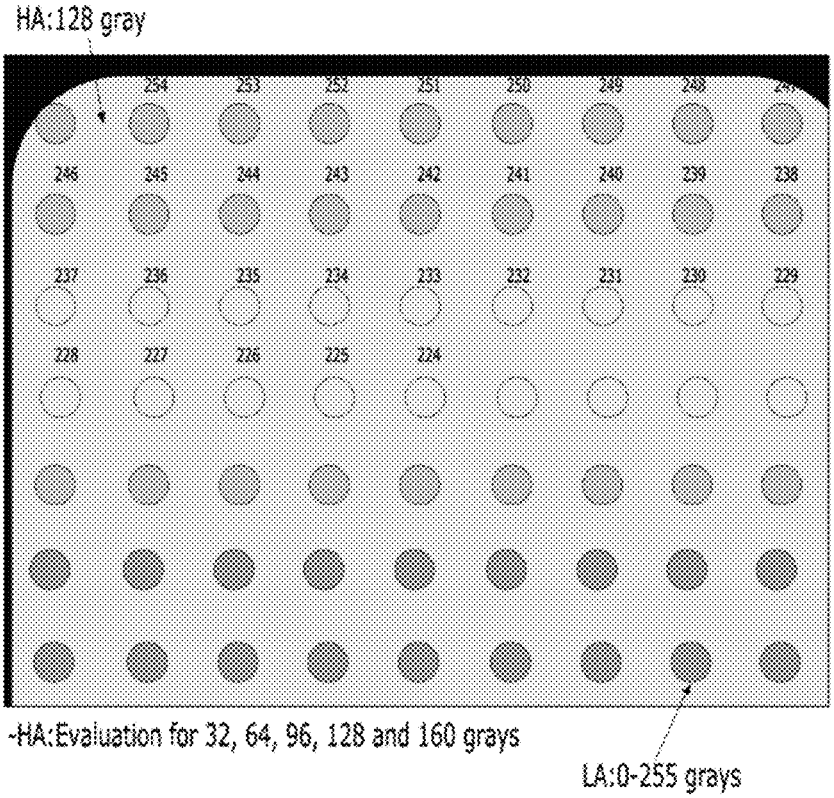
FIG. 7 is a diagram showing a luminance deviation evaluation pattern and an evaluation method for a low-resolution area in contrast to a high-resolution area according to an embodiment.
Figure 8:
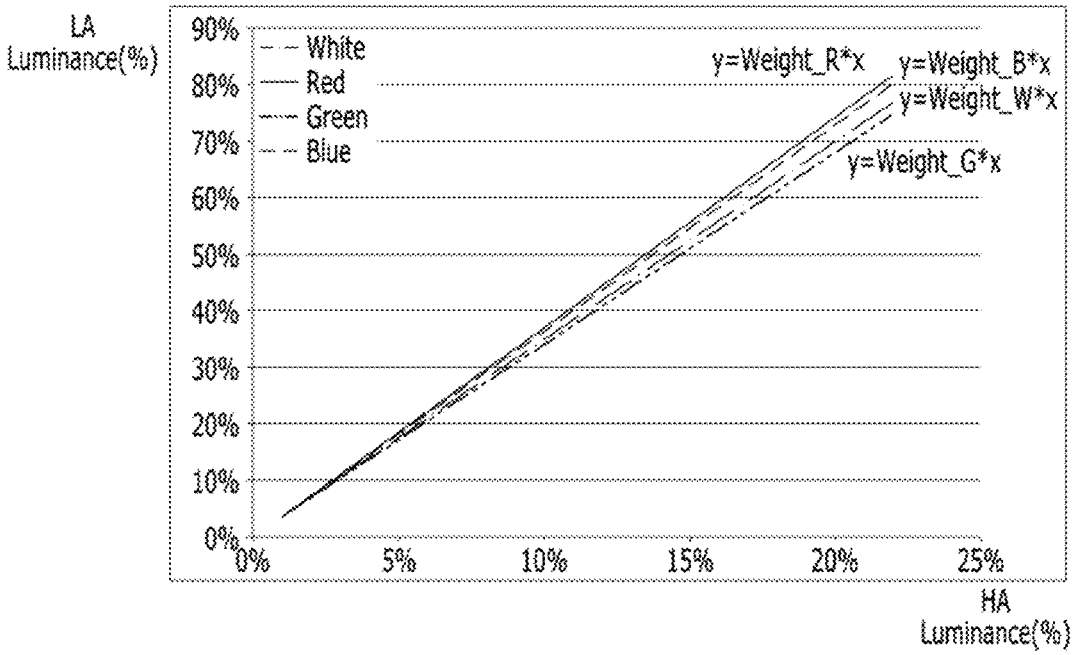
FIG. 8 is a graph showing results of derivation of a maximum compensation amount for each color for luminance compensation of a low-resolution area in contrast to a high-resolution area according to an embodiment.

The color weights Weight_W, Weight_R, Weight_G and Weight_B in Mathematical Expression 2 can be derived as shown in the graph of FIG. 8 on the basis of a recognition evaluation pattern and an evaluation method shown in FIG. 7.

Referring to FIG. 7, luminance differences of the low-resolution area LA in contrast to the high-resolution area HA can be measured for colors and gray values on the basis of luminance recognition evaluation using an evaluation pattern in which low-resolution areas LA expressing 256 gray values of 0 to 255 for a plurality of gray values (32, 64, 96, 128, 160) of the high-resolution area HA are displayed. Then, color weights Weight_W, Weight_R, Weight_G and Weight_B having luminance percentages of the low-resolution area LA to the high-resolution area HA can be derived as compensation values as shown in a linear function graph of FIG. 8. Referring to FIG. 8, it can be ascertained that R weight Weight_R and B weight Weight_B need to be greater than G weight Weight_G in order to reduce a luminance difference of the low-resolution area LA in contrast to the high-resolution area HA. In other words, it can be ascertained that RB data needs a higher luminance increase rate than G data in order to reduce luminance differences of the low-resolution area LA in contrast to the high-resolution area HA. It can be ascertained that W weight Weight_W is greater than G weight Weight_G and less than B weight Weight_B.

FIGS. 9A through 9D are diagrams showing luminance compensation effects of a low-resolution area using a luminance compensation method according to an embodiment.

Figure 9A:
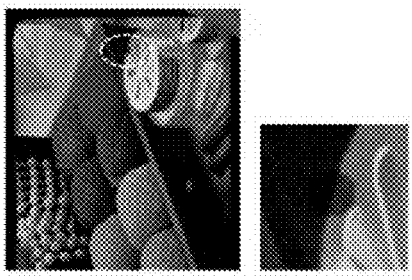
FIGS. 9A, 9B, 9C, and 9D are diagrams showing luminance compensation effects of a low-resolution area according to an embodiment.
Figure 9B:
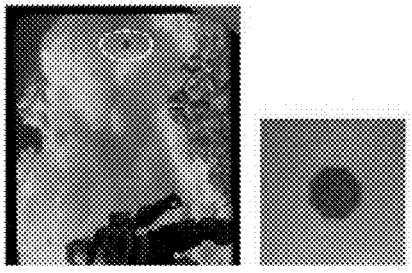
Figure 9C:
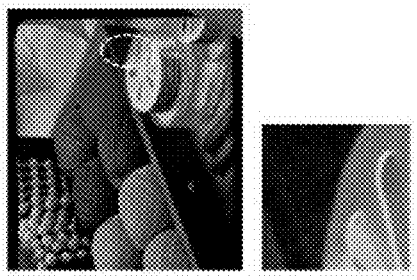
Figure 9D:
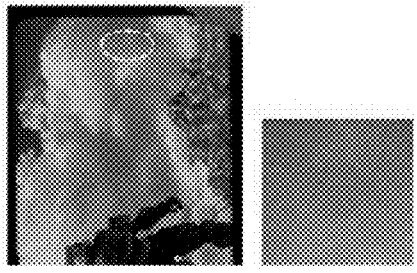

Referring to FIGS. 9A through 9D, it can be ascertained that luminance deterioration in low-resolution areas LA is recognized before luminance compensation using color weights according to an embodiment is performed on the low-resolution areas LA, as shown in FIGS. 9A and 9B. On the other hand, when the timing controller 400 compensates for the luminance of the low-resolution areas LA by applying color weights according to an embodiment thereto, the luminance of the low-resolution areas is improved to a level equivalent or similar to that of high-resolution areas such that luminance deterioration in the low-resolution areas is not visually recognized, as shown in FIGS. 9C and 9D.

FIGS. 10A through 10D are diagrams showing smoothing processing performed on a boundary area of a low-resolution area having a high grayscale according to an embodiment.

Referring to FIGS. 10A through 10D, an image with a high grayscale on which luminance compensation cannot be performed, for example, high grayscale (high luminance) exceeding 135 gray and close to 255 gray, may be displayed in a low-resolution area LA, as described above. In this case, a luminance difference between the low-resolution area and a high-resolution area may be markedly recognized in the boundary area, as shown in FIGS. 10A and 10B. To improve this, the timing controller 400 can apply smoothing image processing of gradually reducing luminance according to pixel position from the high-resolution area to the low-resolution area, as shown in FIGS. 10C and 10D. Consequently, it can be ascertained that a luminance difference between the high-resolution area and the low-resolution area is gradually improved according to pixel position.

FIGS. 11A through 11D are diagrams showing an octagonal low-resolution area according to an embodiment.

Referring to FIGS. 11A through 11D, a low-resolution area LA according to an embodiment has an octagonal shape, as shown in FIGS. 11A and 11B, such that a pixel arrangement structure at a boundary between the low-resolution area LA and a high-resolution area HA for preventing visual recognition of the boundary can be designed. It can be ascertained that a luminance deviation or color variation between the high-resolution area HA and the low-resolution area LA is uniform when the octagonal low-resolution area LA has the same slope in the boundary area, as shown in FIGS. 11C and 11D. Accordingly, it is possible to curb visual recognition of the boundary area by varying the pixel arrangement structure in the boundary area according to the slope of the boundary area in consideration of only eight sides and eight vertexes of the octagonal shape of the low-resolution area LA.

FIGS. 12A through 14C are diagrams showing pixel arrangement structures in a boundary area between a high-resolution area and a low-resolution area according to boundary slopes according to an embodiment.

Referring to FIGS. 12A through 14C, outermost unit pixels RGBG of the high-resolution area neighboring the low-resolution area LA may be defined as unit pixels of a boundary area BA. The boundary area BA of the high-resolution area HA neighboring the low-resolution area LA includes first to eighth boundary areas BA1 to BA8 having slopes of 0°, 45°, 135° and 90° in the x-axis direction. In the first to eighth boundary areas BA1 to BA8, transmission areas TA are disposed according to the slopes of corresponding boundary areas without removing unit pixels of the boundary area BA at regular intervals. Different arrangements of unit pixels and transmission areas TA are determined for the first to eighth boundary areas BA1 to BA8 according to the slopes of the boundary areas BA1 to BA8. The first to eighth boundary areas BA1 to BA8 may include one unit pixel per area of two unit pixels and a transmission area corresponding to one unit pixel area or three unit pixels per area of four unit pixels and a transmission area corresponding to one unit pixel area according to the slopes thereof. The first to eighth boundary areas BA1 to BA8 have PPI higher than that of the low-resolution area LA and lower than that of the high-resolution area HA.

Referring to FIGS. 12A, 12B, and 12C, the first and second boundary areas BA1 and BA2 of the high-resolution area HA adjacent to unit pixels of the low-resolution area LA are positioned at a slope of 0° in the x-axis direction and face each other in the y-axis direction. The first and second boundary areas BA1 and BA2 include one unit pixel per area of two unit pixels, and a transmission area corresponding to one unit pixel area which are positioned in the x-axis direction. The first and second boundary areas BA1 and BA2 have a structure in which a (2k−1)-th unit pixel or a 2k-th unit pixel among two unit pixels neighboring in the x-axis direction is not removed and the transmission area TA is disposed in the corresponding region. The (2k−1)-th unit pixel is not removed and the transmission area TA may be disposed in the corresponding region in the first boundary area BA1, and the 2k-th unit pixel is not removed and the transmission area TA may be disposed in the corresponding region in the second boundary area BA2. On the contrary, the 2k-th unit pixel is not removed and the transmission area TA may be disposed in the corresponding region in the first boundary area BA1, and the (2k−1)-th unit pixel is not removed and the transmission area TA may be disposed in the corresponding region in the second boundary area BA2.

Referring to FIG. 12B, the unit pixels disposed in the first and second boundary areas BA1 and BA2 may be arranged in a 45° diagonal direction with respect to unit pixels of the neighboring low-resolution area LA. The transmission areas TA disposed in the first and second boundary areas BA1 and BA2 may be arranged in a 45° diagonal direction with respect to the unit pixels of the neighboring low-resolution area LA.

Referring to FIGS. 13A, 13B, and 13C, the third and fourth boundary areas BA3 and BA4 of the high-resolution area HA adjacent to the unit pixels of the low-resolution area LA are positioned in a first diagonal direction at a slope of 45° with respect to the x-axis direction, and the fifth and sixth boundary areas BA5 and BA6 are positioned in a second diagonal direction at a slope of 135° with respect to the x-axis direction. The third and fourth boundary areas BA3 and BA4 face each other in the second diagonal direction and the fifth and sixth boundary areas BA5 and BA6 face each other in the first diagonal direction.

The third to sixth boundary areas BA3, BA4, BA5 and BA6 include one unit pixel per area of two unit pixels, and a transmission area TA corresponding to one unit pixel area which are positioned in the first or second diagonal direction. The third and fourth boundary areas BA3 and BA4 have a structure in which a (2k−1)-th unit pixel or a 2k-th unit pixel among two unit pixels neighboring in the 45° first diagonal direction is not removed and the transmission area TA is disposed in the corresponding region. The fifth and sixth boundary areas BA5 and BA6 have a structure in which a (2k−1)-th unit pixel or a 2k-th unit pixel among two unit pixels neighboring in the 135° second diagonal direction is not removed and the transmission area TA is disposed in the corresponding region. For example, the (2k−1)-th unit pixel between two unit pixels neighboring in the first or second diagonal direction is not removed and the transmission area TA may be disposed in the corresponding region in the third to sixth boundary areas BA3, BA4, BA5 and BA6. On the contrary, the 2k-th unit pixel between two unit pixels neighboring in the first or second diagonal direction is not removed and the transmission area TA may be disposed in the corresponding region in the third to sixth boundary areas BA3, BA4, BA5 and BA6.

Referring to FIG. 13B, the unit pixels disposed in the third to sixth boundary areas BA3, BA4, BA5 and BA6 may be arranged in a 45° or 135° diagonal direction with respect to the unit pixels of the neighboring low-resolution area LA. The transmission areas TA disposed in the third to sixth boundary areas BA3, BA4, BA5 and BA6 may be arranged adjacent to the unit pixels of the neighboring low-resolution area LA in the x-axis direction.

Figure 14A:
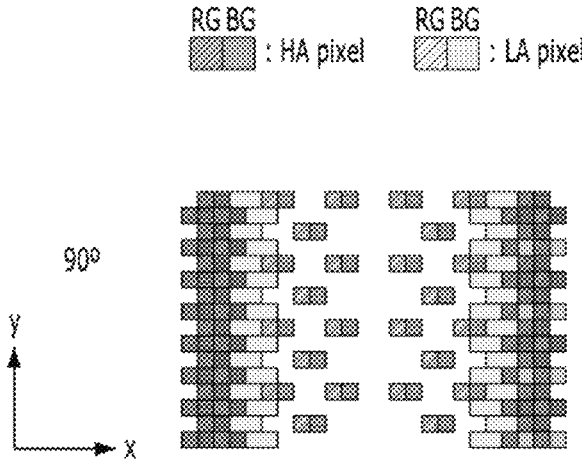
FIGS. 14A, 14B, and 14C are diagrams showing a pixel arrangement structure at a boundary area between a high-resolution area and a low-resolution area in a y direction according to an embodiment.
Figure 14B:
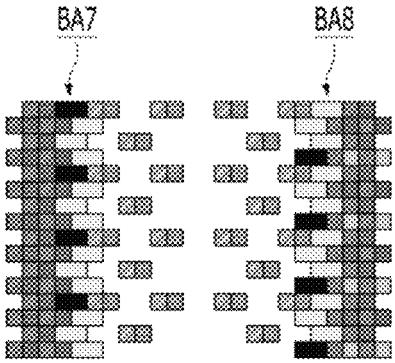
Figure 14C:
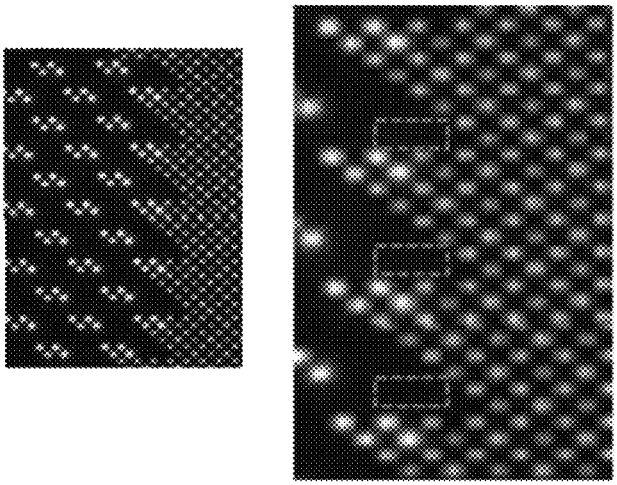

Referring to FIGS. 14A, 14B, and 14C, the seventh and eighth boundary areas BA7 and BA8 of the high-resolution area HA adjacent to the unit pixels of the low-resolution area LA are positioned in the y-axis direction at a slope of 90° with respect to the x-axis direction and face each other in the x-axis direction. The seventh and eighth boundary areas BA7 and BA8 include three unit pixels 7 per area of four unit pixels, and a transmission area corresponding to one unit pixel area which are positioned in the y-axis direction. The seventh and eighth boundary areas BA7 and BA8 have a structure in which a (4k−3)-th unit pixel or a 4k-th unit pixel among four unit pixels disposed in the y-axis direction is not removed and the transmission area TA is disposed in the corresponding region. The (4k−3)-th unit pixel among four unit pixels disposed in the y-axis direction is not removed and the transmission area TA may be disposed in the corresponding region in the seventh boundary area BA7. The 4k-th unit pixel among four unit pixels disposed in the y-axis direction is not removed and the transmission area TA may be disposed in the corresponding region in the eighth boundary area BA8. On the contrary, The 4k-th unit pixel among four unit pixels disposed in the y-axis direction is not removed and the transmission area TA may be disposed in the corresponding region in the seventh boundary area BA7, and the (4k−3)-th unit pixel among four unit pixels disposed in the y-axis direction is not removed and the transmission area TA may be disposed in the corresponding region in the eighth boundary area BA8.

Referring to FIG. 14B, the unit pixels disposed in the seventh boundary area BA7 may be arranged adjacent to the unit pixels of the neighboring low-resolution area LA in the x-axis direction, and the transmission areas TA disposed in the seventh boundary area BA7 may be arranged adjacent to the unit pixels of the neighboring low-resolution area LA in the x-axis direction. The unit pixels disposed in the eighth boundary area BA7 may be arranged adjacent to transmission areas or unit pixels of the neighboring low-resolution area LA in the x-axis direction, and the transmission areas TA disposed in the eighth boundary area BA8 may be arranged adjacent to the transmission areas of the neighboring low-resolution area LA in the x-axis direction.

FIGS. 15A through 17 are diagrams showing optimal pixel arrangement structures at a boundary and luminance compensation effects of a low-resolution area according to an embodiment.

Figure 15A:
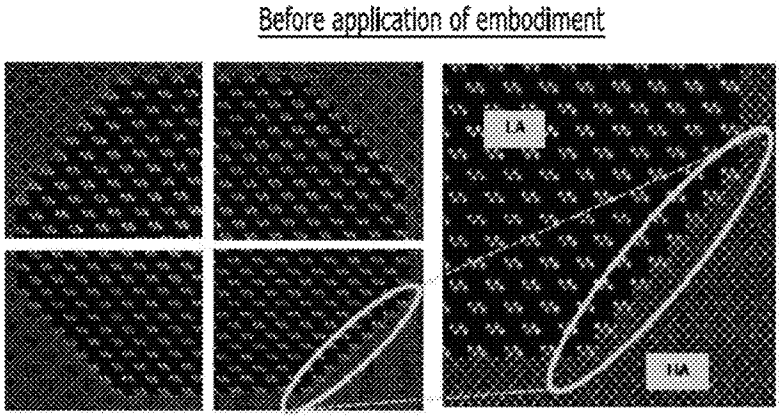
FIGS. 15A, 15B, 15C, and 15D are diagrams showing optimal pixel arrangement in a boundary area and luminance compensation effects of a low-resolution area according to an embodiment.
Figure 15B:
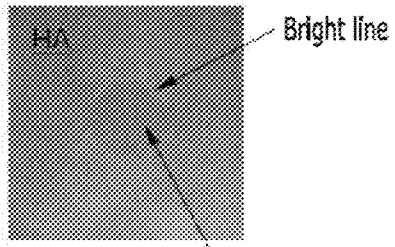

Referring to FIGS. 15A and 15B, unit pixels on which luminance compensation has been performed in a low-resolution area LA immediately neighbor unit pixels of a high-resolution area HA and thus a bright line defect may be generated at the boundary of the low-resolution area LA when the embodiment of the pixel arrangement structure for a boundary described in FIGS. 12A through 14C is not applied.

Figure 15C:
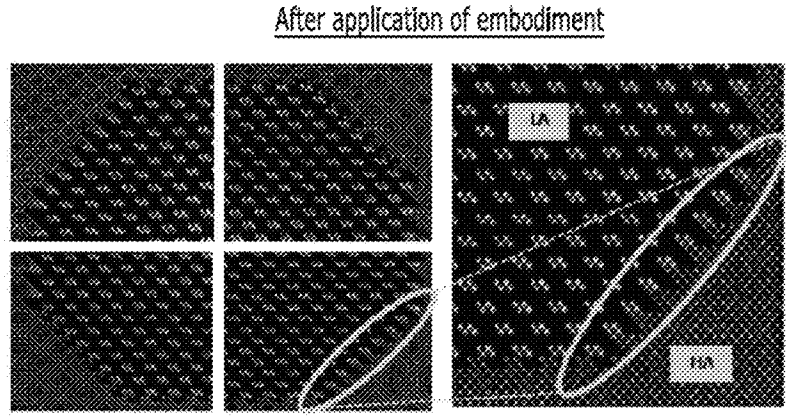
Figure 15D:
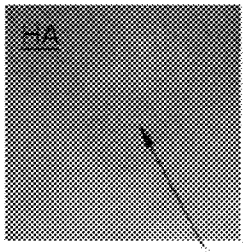

Referring to FIGS. 15C and 15D, it can be ascertained that the boundary of the low-resolution area LA is not visually recognized and luminance deterioration in the low-resolution area LA is improved when both luminance compensation for the low-resolution area LA and the embodiment of the pixel arrangement structure for a boundary described in FIGS. 12A through 14C are applied.

Figures 16A, 16B, 16C:
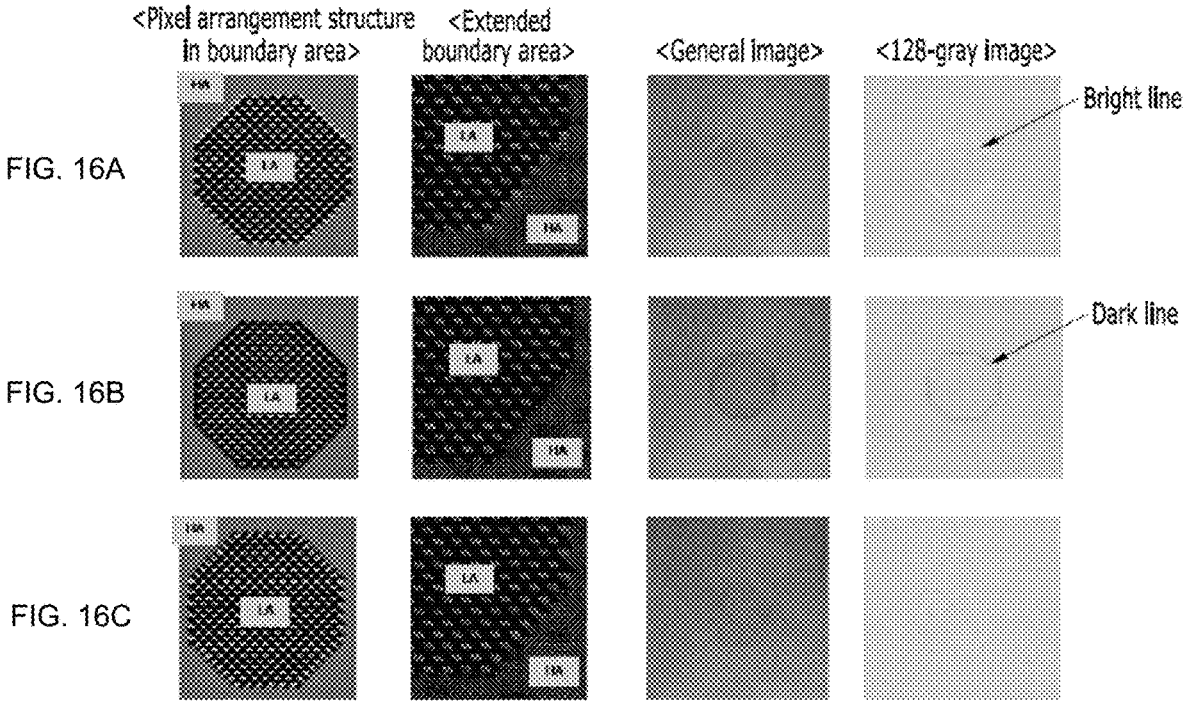
FIGS. 16A, 16B, and 16C are diagrams showing optimal pixel arrangement in a boundary area and luminance compensation effects of a low-resolution area according to an embodiment.

Referring to FIG. 16A, it can be ascertained that a boundary of a low-resolution area LA is visually recognized as a bright line defect in a general image and a 128-gray image if unit pixels on which luminance compensation has been performed in the low-resolution area LA immediately neighbor unit pixels of a high-resolution area HA when the embodiment of the pixel arrangement structure for a boundary described in FIGS. 12A through 14C is not applied.

Referring to FIG. 16B, it can be ascertained that the boundary of the low-resolution area LA is visually recognized as a dark line defect in the general image and the 128-gray image if only transmission areas in the low-resolution area LA immediately neighbor the unit pixels of the high-resolution area HA when the embodiment of the pixel arrangement structure for a boundary described in FIGS. 12A through 14C is not applied.

Referring to FIG. 16C, it can be ascertained that the boundary of the low-resolution area LA is not visually recognized and luminance deterioration in the low-resolution area LA is improved in the general image and the 128-gray image when both luminance compensation for the low-resolution area LA and the embodiment of the pixel arrangement structure for a boundary described in FIGS. 12A through 14C are applied.

Figure 17:
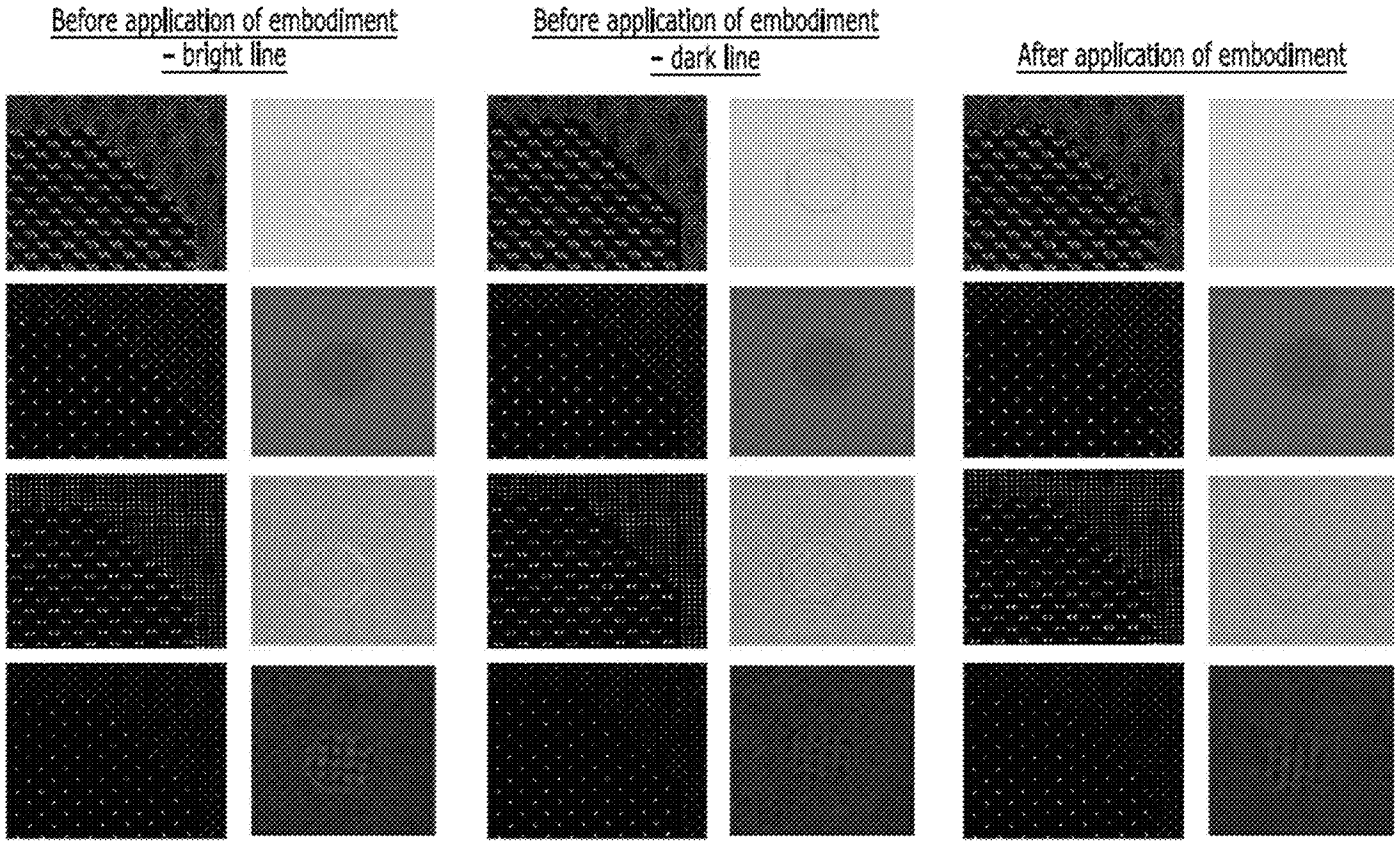
FIG. 17 is a diagram showing optimal pixel arrangement in a boundary area and luminance compensation effects of a low-resolution area for each color image according to an embodiment.

Referring to FIG. 17, when a 128-gray image, a red image, a green image, and a blue image are displayed in a display area, it can be ascertained that boundaries of low-resolution areas LA are visually recognized as bright line defects or dark line defects in the color images when the embodiment of the pixel arrangement structure for a boundary described in FIGS. 12A through 14C is not applied. On the other hand, when both luminance compensation for the low-resolution area LA and the embodiment of the pixel arrangement structure for a boundary described in FIGS. 12A through 14C are applied, the boundaries of the low-resolution areas LA are not visually recognized and luminance deterioration in the low-resolution areas LA is improved in the color images.

As described above, the display device according to an embodiment can prevent the boundary area of a low-resolution area from being visually recognized and improve definition deterioration in the low-resolution area by compensating for the luminance of the low-resolution area and differently arranging unit pixels and transmission areas in the boundary area of a high-resolution area adjacent to the low-resolution area having an octagonal shape according to slopes of the boundary area, thereby enhancing overall definition.

It will be apparent to those skilled in the art that various modifications and variations can be made in the present disclosure without departing from the spirit or scope of the disclosure. Thus, it is intended that the present disclosure cover the modifications and variations of this disclosure provided they come within the scope of the appended claims and their equivalents.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A display device, comprising:

a panel including a display area in which a plurality of pixels is arranged, the panel having a high-resolution area, a low-resolution area, and a boundary area between the high-resolution area and the low-resolution area; and an optical module superposed on the low-resolution area of the display area, the optical module neighboring the high-resolution area, wherein, in the low-resolution area and the boundary area, unit pixels are arranged in a lower pixel density than that of the high-resolution area and transmission areas are disposed adjacent to the unit pixels, wherein the unit pixels of the boundary area include outermost unit pixels disposed at a boundary between the high-resolution area and the low-resolution area, wherein the unit pixels of the low-resolution area are spaced apart from the unit pixels of the high-resolution area by the unit pixels of the boundary area, wherein at least one transmission area among the transmission areas is disposed in the boundary area, wherein the at least one transmission area in the boundary area is surrounded by the unit pixels of the low-resolution area, the unit pixels of the high-resolution area, and the unit pixels of the boundary area, and wherein the unit pixels of the boundary area and the at least one transmission area of the boundary area are arranged in different forms based on slopes of the boundary area.

2. The display device of claim 1, wherein the low-resolution area has an octagonal shape, and the boundary area of the high-resolution area has a plurality of boundary areas having different slopes.

3. The display device of claim 2, wherein the plurality of boundary areas of the high-resolution area includes first and second boundary areas disposed along a first direction and facing each other along a second direction that is transverse to the first direction, wherein the first and second boundary areas include one unit pixel per area of two unit pixels and a transmission area among the transmission areas corresponding to each unit pixel area positioned along the first direction, and wherein a position of a transmission area per area of two unit pixels in the first boundary area is opposite to a position of a transmission area per area of two unit pixels in the second boundary area.

4. The display device of claim 3, wherein the plurality of boundary areas of the high-resolution area includes third and fourth boundary areas disposed along a first diagonal direction at a slope of 45° to the first direction and fifth and sixth boundary areas disposed in a second diagonal direction at a slope of 135° to the first direction, wherein the third and fourth boundary areas include one unit pixel per area of two unit pixels and a transmission area among the transmission areas corresponding to each unit pixel area positioned along the first diagonal direction, and the fifth and sixth boundary areas include one unit pixel per area of two unit pixels and a transmission area among the transmission areas corresponding to each unit pixel area positioned along the second diagonal direction, and wherein the transmission area per area of two unit pixels is disposed at the same position in the third to sixth boundary areas.

5. The display device of claim 4, wherein the plurality of boundary areas of the high-resolution area includes seventh and eighth boundary areas disposed along the second direction and facing each other along the first direction, wherein the seventh and eighth boundary areas include one unit pixel per area of four unit pixels and a transmission area among the transmission areas corresponding to each unit pixel area positioned in the y-axis direction, and wherein a position of a transmission area per area of four unit pixels in the seventh boundary area is different from a position of a transmission area per area of four unit pixels in the eighth boundary area.

6. The display device of claim 5, wherein a transmission area of the seventh boundary area is positioned in the area of the first unit pixel per area of four unit pixels in the seventh boundary area, and a transmission area of the eighth boundary area is positioned in the area of the fourth unit pixel per area of four unit pixels in the eighth boundary area.

7. The display device of claim 1, wherein the low-resolution area includes one unit pixel per area of four unit pixels and a transmission area corresponding to three unit pixel areas.

8. The display device of claim 1, wherein the area of the low-resolution area is larger than the area of a region where the low-resolution area is superposed on the optical module.

9. The display device of claim 1, comprising:

a plurality of optical modules including the optical module; and a plurality of low-resolution areas including the low-resolution area, wherein the plurality of low-resolution areas is superposed on the plurality of optical modules.

10. The display device of claim 1, comprising a driver for driving the panel, wherein a timing controller included in the driver compensates for luminance by applying different weights for colors to image data of the low-resolution area, and wherein the different color weights are derived using proportions of luminances for colors of the low-resolution area to those of the high-resolution area using results of measurement of luminance differences for colors in the low-resolution area in contrast to the high-resolution area.

11. The display device of claim 10, wherein the timing controller converts input 3-color data for the low-resolution area into 4-color data, applies the color weights to the converted 4-color data to generate corrected 4-color data, converts the corrected 4-color data into corrected 3-color data, and outputs the corrected 3-color data.

12. The display device of claim 11, wherein the color weights are less than a maximum weight using a ratio of a number of unit pixels per mask area of the high-resolution area to a number of unit pixels per mask area of the low-resolution area.

13. The display device of claim 11, wherein the timing controller performs de-gamma processing on the color weights and applies the de-gamma processed color weights to the converted 4-color data.

14. The display device of claim 13, wherein a red weight and a blue weight among the color weights are greater than a green weight, and a white weight is greater than the green weight and less than the blue weight.

15. The display device of claim 11, wherein the timing controller derives a maximum gray range that is able to be compensated using the color weights using a ratio of a number of unit pixels per mask area of the low-resolution area to a number of unit pixels per mask area of the high-resolution area in image data of the low-resolution area, and performs luminance compensation on grays equal to or greater than 0 gray and equal to or less than the maximum gray range that is able to be compensated using the color weights.

16. The display device of claim 15, wherein the timing controller performs luminance compensation on high-gray data exceeding the maximum gray range that is able to be compensated by applying smoothing processing of gradually reducing luminance from the high-resolution area to the low-resolution area to the high-gray data.

17. The display device of claim 1, wherein at least one portion of the boundary area only includes a transmission area.

18. The display device of claim 1, wherein the at least one transmission area is disposed in an area where unit pixels are not present.

19. A display device, comprising:

a panel including a display area in which a plurality of pixels is arranged, the panel having a high-resolution area, a low-resolution area, and a boundary area between the high-resolution area and the low-resolution area; and an optical module superposed on the low-resolution area of the display area, the optical module neighboring the high-resolution area, wherein, in the low-resolution area and the boundary area, unit pixels are arranged in a lower pixel density than that of the high-resolution area, wherein the unit pixels of the boundary area include outermost unit pixels disposed at a boundary between the high-resolution area and the low-resolution area, wherein the unit pixels of the low-resolution area are spaced apart from the unit pixels of the high-resolution area by the unit pixels of the boundary area, wherein at least one transmission area is disposed at at least one location of the unit pixels of the boundary area, wherein the at least one transmission area at the at least one location of the unit pixels of the boundary area abuts the unit pixels of the low-resolution area and the unit pixels of the boundary area, and wherein the unit pixels of the boundary area and the at least one transmission area of the boundary area are arranged in different forms based on slopes of the boundary area.

20. The display device of claim 19, wherein the low-resolution area has an octagonal shape, and the boundary area of the high-resolution area has a plurality of boundary areas having different slopes.

* * * * *